US005823078A

United States Patent [19]

Liu

[11] Patent Number: 5,823,078

[45] Date of Patent: Oct. 20, 1998

[54] PRECISION SCREWDRIVER EQUIPPED WITH A ROTATABLE CAP

[76] Inventor: Tsai-Fa Liu, No. 88, Lane 412, Chen Hsing Rd., Taichung City, Taiwan

[21] Appl. No.: 782,673

[22] Filed: Jan. 15, 1997

[51] Int. Cl.[6] ..... B25B 15/00

[52] U.S. Cl. ..... 81/436; 81/177.7; 81/492

[58] Field of Search ..... 81/436, 177.7, 81/177.1, 180.1, 180.2, 489, 492

[56] References Cited

U.S. PATENT DOCUMENTS

| | | | |
|---|---|---|---|
| 1,049,650 | 1/1913 | Benjamin | 81/436 |
| 1,772,040 | 8/1930 | Dunlea | 81/436 X |
| 2,351,705 | 6/1944 | Prall | 81/436 |
| 2,635,660 | 4/1953 | Dawson | 81/436 |
| 2,849,041 | 8/1958 | Vetri | 81/177.1 |
| 3,343,577 | 9/1967 | Wagner | 81/436 X |
| 4,093,008 | 6/1978 | Martin | 81/436 X |
| 5,431,075 | 7/1995 | Cruz et al. | 81/436 X |

*Primary Examiner*—D. S. Meislin
*Attorney, Agent, or Firm*—Bacon & Thomas

[57] ABSTRACT

A precision screwdriver having a handle with a rotatable portion consisting of a shaft, a handle, a thrust ring and a rotatable cap. The handle has a cylindrical portion with a raised edge formed on its outer surface, and an internal cavity. The rotatable cap is equipped with a hole therethrough for holding a bearing in the form of a single ball. An internal groove disposed at near the hole serves a securing function when the raised edge of the cylindrical portion of the handle is fitted to the rotatable cap internal groove. A concave securing plate with a hole therethrough is disposed on the outer edge of the rotatable cap hole. The securing plate serves to position the bearing with suitable surface exposed through the securing plate hole. Thus, the rotatable cap can be fitted onto the cylindrical portion of the handle and properly secured by mating the raised edge with the internal groove. The bearing is inserted into the rotatable cap hole through the top of the rotatable cap and is retained between the handle cavity and the rotatable cap by the securing plate. In use, the index finger is placed on the exposed bearing which serves as a rotating point. Consequently, when pressure is applied, the shaft and handle revolve independently of the rotation of the bearing and the rotatable cap.

5 Claims, 3 Drawing Sheets

PRECISION SCREWDRIVER EQUIPPED WITH A ROTATABLE CAP

BACKGROUND OF THE INVENTION

1. Field of the Invention

The invention relates to a type of precision screwdriver. More specifically, the invention is a screwdriver having a rotatable cap that rotates on an exposed bearing. The screwdriver is intended to be grasped between the thumb and middle finger while the index finger is positioned atop the rotatable cap. A key feature of the invention is that, according to the design of the present invention, relatively little force is required to press on the rotating cap while the screwdriver is rotated by the thumb and finger, thereby allowing a more comfortable application of pressure to secure and remove screws, over that required by the conventional screwdriver.

2. Related Technology

An example of a conventional precision screwdriver structure is shown in FIG. 4 and FIG. 5. The device consists of a screwdriver shaft (10), a handle (11), a thrust ring (12) and a rotatable cap (13). The rotatable cap (13) is secured to the main structure by an external annular raised ridge (15) on a cylindrical portion (14) of the handle (11) along with an internal annular groove (17) of the inner opening (16). Therefore, with reference to FIG. 3 for the specific holding method, when held by pressing the index finger on the connecting plate (18) of the rotatable cap (13) and by rotating the handle (11) with thumb and middle finger, the handle and (11) and shaft (10) will revolve to secure or remove screws while the rotatable cap (13) remains stationary.

BRIEF SUMMARY OF THE INVENTION

The structure of the aforementioned conventional precision screwdriver may appear to be reasonable, however, it requires considerable strength to be applied at the uppermost end of the screwdriver handle to tighten or loosen a screw. Consequently, when pressure is applied, greater friction is produced between the rotatable cap (13) and the thrust ring (12). For the same reason, friction also occurs at the contact surface between the thrust ring (12) and the handle (11). As a result, the rotatable cap (13) rotates along with the handle (11), resulting in the loss of its ability to rotate independently of the handle.

The invention seeks to improve on the defects of the conventional precision screwdriver by improving the bearing structure to achieve the objective of maintaining the revolving function despite the amount of pressure applied.

The apparatus, method and function along with examples and drawings are detailed as follows:

DETAILED DESCRIPTION OF A PREFERRED EMBODIMENT OF THE INVENTION

Figure 1:
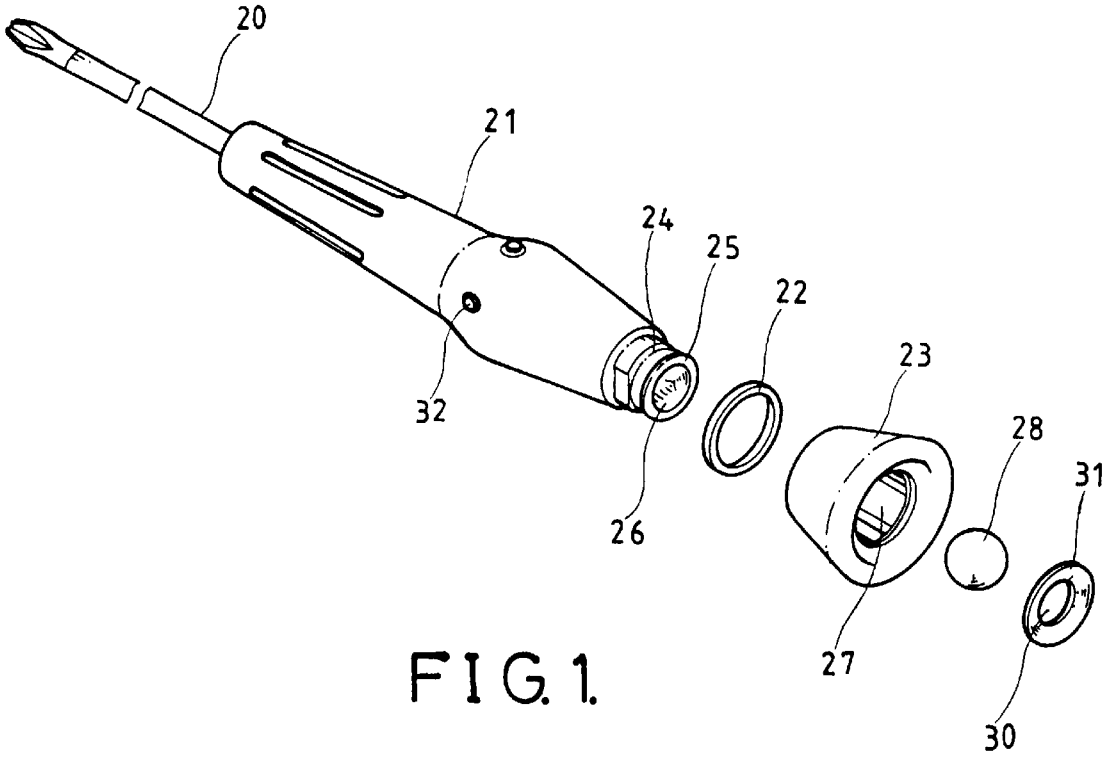
FIG. 1 is an exploded view of the invention.
Figure 2:
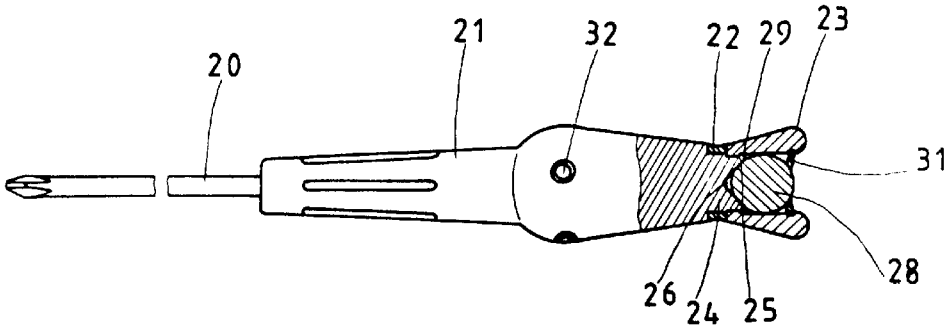
FIG. 2 is a sectional view of the invention assembly.

As shown in FIG. 1 and FIG. 2, the present invention consists of a screwdriver shaft (20), a handle (21), thrust ring (22) and a rotatable cap (23). The thrust ring (22) is mounted on an exterior surface of a cylindrical portion (24) of the handle (21) and is disposed between the handle (21) and the rotatable cap (23). A primary feature of the present invention is that the handle (21) has a cylindrical portion (24) with a raised edge (25) formed on its outer circumference. The handle also has an internal cavity (26).

The rotatable cap (23) is equipped with a hole (27) therethrough for holding a bearing (28) in the form of a single ball. An internal annular groove (29) is disposed at an appropriate location near the handle end of the hole (27) which serves as a securing function when the raised edge (25) of the cylindrical portion (24) of the handle (21) is fitted to the internal annular groove (29) of the rotatable cap (23). A concave securing plate (31) with a hole therethrough (30) is disposed on the opposite, outer edge of the hole (27) of the rotatable cap (23), and serves to position the bearing (28) with suitable surface exposed through the hole (30) of the securing plate (31).

Figure 3:
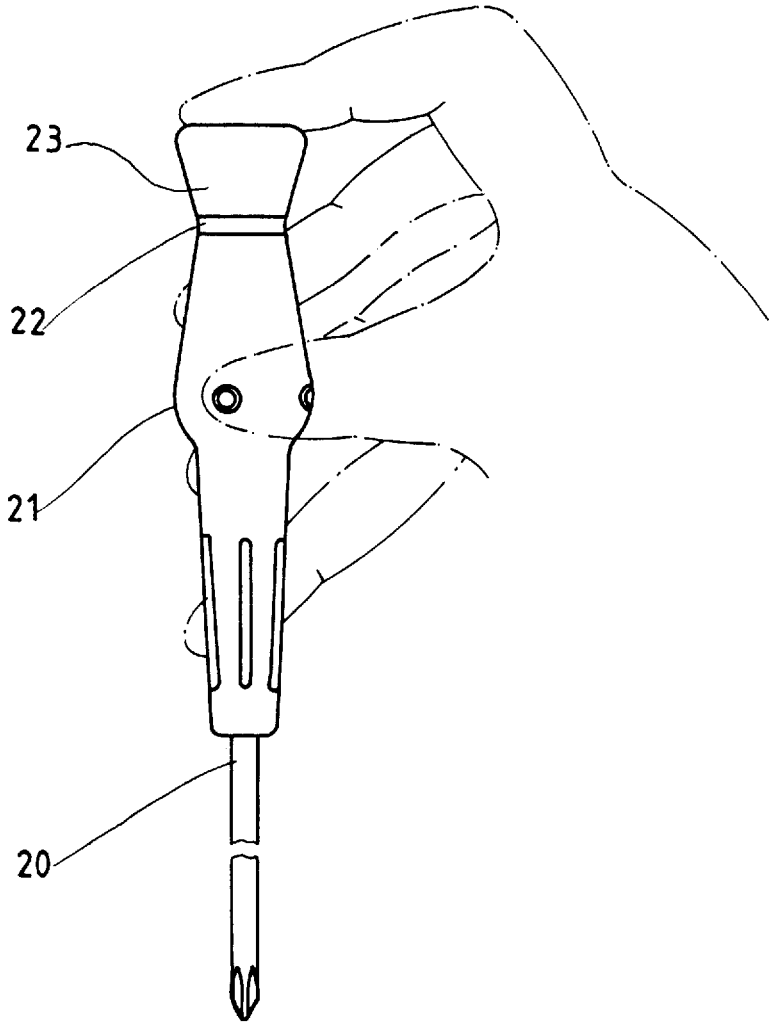
FIG. 3 is an example application of the invention.
Figure 4:
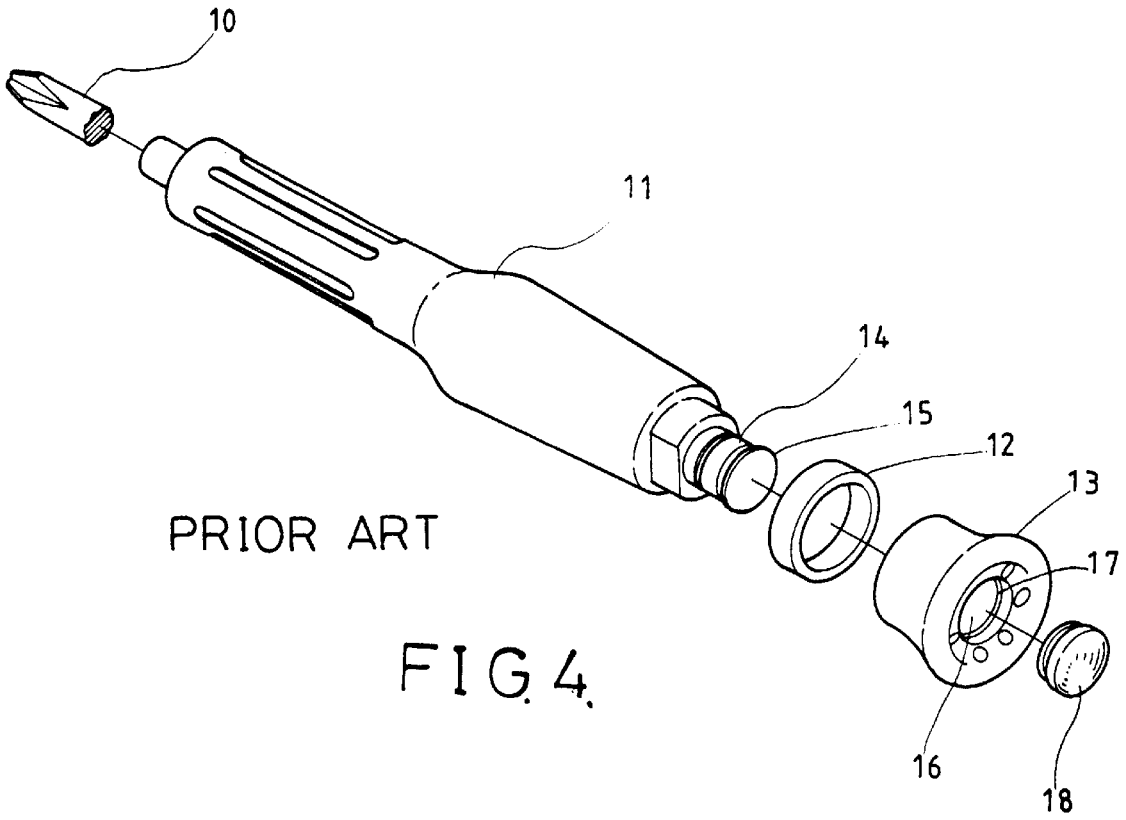
PRIOR ART FIG. 4.
FIG. 4 is an exploded view of the conventional precision screwdriver.
Figure 5:
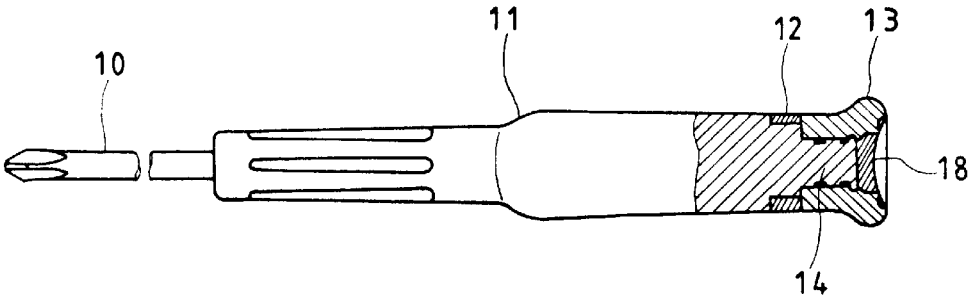
FIG. 5. PRIOR ART
FIG. 5 is a sectional view of the typical precision screwdriver assembly.

Thus, the rotatable cap (23) can be fitted onto the cylindrical portion (24) of the handle (21) through the hole (27) and properly secured by fitting the raised edge (25) into the internal annular groove (29). Bearing (28) is inserted into the hole (27) through the top of the rotatable cap (23) and is held by the cavity (26) inside the handle (21). As shown in FIG. 3, the user is able to place an index finger on the exposed bearing which serves as a rotating point. Consequently, when pressure is applied, the shaft (20) and handle (21) revolve independently of the rotation of the bearing (28) and of the rotatable cap (23).

To enable easy operation, a plurality of protruding portions (32) are disposed on appropriate locations on the handle (21) to provide friction, when gripped by the user.

In summary, this invention provides a practical enhancement over the conventional precision screwdriver. Furthermore, no similar product or literature has been found in the market. It is practical and innovative.

I claim:

1. A precision screwdriver comprising:

a shaft adapted for driving and removing screws;

a handle, said handle having a cap holding end and a shaft holding end which holds said shaft, wherein said cap holding end has an external annular raised ridge;

a rotatable cap, said rotatable cap having an internal annular groove; and a single ball, wherein said external annular raised ridge of said cap holding end is rotatably mated with said internal annular groove of said rotatable cap so that said single ball is rotatably retained between said rotatable cap and said cap holding end of said handle.

2. The precision screwdriver of claim 1, further comprising:

a thrust ring, said thrust ring being mounted on an exterior surface of said cap holding end and disposed between said handle and said rotatable cap.

3. The precision screwdriver of claim 1, wherein said handle further comprises a plurality of protruding portions, said plurality of protruding portions being disposed on an exterior handle surface to provide frictional contact with the fingers and thumb of a user.

4. A precision screwdriver comprising:

a shaft adapted for driving and removing screws;

a handle, said handle having a cap holding end and a shaft holding end which holds said shaft, wherein said cap holding end has an external annular raised ridge;

a rotatable cap, said rotatable cap having an internal annular groove;

a thrust ring, said thrust ring being mounted on an exterior surface of said cap holding end and disposed between said handle and said rotatable cap;

a securing plate having an opening therethrough, said securing plate being held within said rotatable cap; and a single ball, wherein said external annular raised ridge of said cap holding end is rotatably mated with said internal annular groove of said rotatable cap so that said single ball is rotatably retained between said securing plate and said cap holding end of said handle, wherein said single ball is rotatably captured in said securing plate opening.

5. The precision screwdriver of claim 4, wherein said handle further comprises a plurality of protruding portions, said plurality of protruding portions being disposed on an exterior handle surface to provide frictional contact with the fingers and thumb of a user.

* * * * *